US010633851B2

(12) United States Patent
Mou et al.

(10) Patent No.: US 10,633,851 B2
(45) Date of Patent: Apr. 28, 2020

(54) ASSEMBLED SELF-RECOVERY CIRCULAR CONCRETE-FILLED STEEL-TUBE COMPOSITE JOINT

(71) Applicant: QINGDAO UNIVERSITY OF TECHNOLOGY, Qingdao (CN)

(72) Inventors: Ben Mou, Qingdao (CN); Peng Feng, Beijing (CN); Xi Li, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/480,314

(22) PCT Filed: Apr. 12, 2018

(86) PCT No.: PCT/CN2018/082751
§ 371 (c)(1),
(2) Date: Jul. 24, 2019

(87) PCT Pub. No.: WO2019/119686
PCT Pub. Date: Jun. 27, 2019

(65) Prior Publication Data

US 2019/0376273 A1 Dec. 12, 2019

(30) Foreign Application Priority Data

Dec. 21, 2017 (CN) ..... 2017 1 1390229

(51) Int. Cl.
*E04B 1/21* (2006.01)
*E04B 1/24* (2006.01)

(52) U.S. Cl.
CPC ..... *E04B 1/21* (2013.01); *E04B 1/2403* (2013.01); *E04B 2001/2406* (2013.01); *E04B 2001/2418* (2013.01); *E04B 2001/2457* (2013.01)

(58) Field of Classification Search
CPC ..... E04B 1/18; E04B 1/30; E04B 1/21; E04B 1/215; E04B 1/58; E04B 1/5806;
(Continued)

(56) References Cited

U.S. PATENT DOCUMENTS 7,637,076 B2 * 12/2009 Vaughn ..... E02D 27/34 403/169
8,959,867 B2 * 2/2015 Schold ..... E04B 1/185 403/217

(Continued)

FOREIGN PATENT DOCUMENTS

CN 101525904 A 9/2009
CN 104032838 A 9/2014

(Continued)

*Primary Examiner* — Jonathan P Masinick
(74) *Attorney, Agent, or Firm* — Bayramoglu Law Offices LLC

(57) ABSTRACT

An assembled self-recovery circular concrete-filled steel-tube composite joint includes a circular steel-tube column and H-shaped steel beams, where steel bars penetrate through the circular steel-tube column; the circular steel-tube column includes an upper steel-tube column section, a central inserted-connection column section and a lower steel-tube column section; the upper steel-tube column section is connected to the central inserted-connection column section through an upper sleeve connector, and the central inserted-connection column section is connected to the lower steel-tube column section through a lower sleeve connector; and the H-shaped steel beams are connected to the circular steel-tube column through the upper sleeve connector and the lower sleeve connector. According to the assembled self-recovery circular concrete-filled steel-tube composite joint, all members are machined in a factory and are connected on site through bolts.

14 Claims, 3 Drawing Sheets

(58) Field of Classification Search
CPC ..... E04B 1/5812; E04B 1/24; E04B 1/2403; E04B 2001/2406; E04B 2001/2415; E04B 2001/2448; E04B 2001/2478; Y10T 403/44; Y10T 403/34; Y10T 403/341; Y10T 403/349
See application file for complete search history.

(56) References Cited

U.S. PATENT DOCUMENTS

| | | | | |
|---|---|---|---|---|
| 9,797,125 | B2 * | 10/2017 | Takahashi | E04B 1/2403 |
| 2015/0167290 | A1 * | 6/2015 | Puritani | E04B 1/1909<br>52/650.1 |
| 2016/0007738 | A1 * | 1/2016 | Garcia | E21B 19/15<br>211/182 |
| 2016/0097192 | A1 * | 4/2016 | Marquina | E04B 1/24<br>52/655.1 |
| 2018/0347222 | A1 * | 12/2018 | Richards | E04H 9/021 |

FOREIGN PATENT DOCUMENTS

| | | | |
|---|---|---|---|
| CN | 203878780 | U | 10/2014 |
| CN | 204728481 | U | 10/2015 |
| CN | 105888080 | A | 8/2016 |
| CN | 106049691 | A | 10/2016 |
| CN | 107237401 | A | 10/2017 |
| CN | 107338872 | A | 11/2017 |
| CN | 107893481 | A | 4/2018 |
| KR | 20160078785 | A | 7/2016 |
| WO | 2016111459 | A1 | 7/2016 |

* cited by examiner

ASSEMBLED SELF-RECOVERY CIRCULAR CONCRETE-FILLED STEEL-TUBE COMPOSITE JOINT

CROSS REFERENCE TO THE RELATED APPLICATIONS

This application is the national phase entry of International Application No. PCT/CN2018/082751, filed on Apr. 12, 2018, which is based upon and claims priority to Chinese Patent Application No. 201711390229.0, filed on Dec. 21, 2017, the entire contents of which are incorporated herein by reference.

TECHNICAL FIELD

The invention relates to the technical field of structural members for buildings, in particular to an assembled self-recovery circular concrete-filled steel-tube composite joint.

BACKGROUND

Steel structural members constitute a structural system by means of connection joints, and the joint form has a direct influence on the structural integrity and reliability, the construction cycle and the design and construction of accessory members. According to the rotational stiffness, beams and columns of a frame structure are connected in a rigid, flexible, or semi-rigid manner.

At present, rigid connection is most extensively applied, and rigid joints for the beams and columns of the traditional frame comprise all-welded joints, welded-bolted connection joints, and bolted connection joints. It is discovered through research that the first two connection forms may cause brittle fractures due to the poor quality of welding seams at the ends of the beams and the lack of timely and effective protection in earthquakes; and the traditional joints are difficult to restore or reinforce after being damaged, and consequentially, the reliability of the joints cannot be guaranteed or material waste is caused.

As a novel earthquake-control structure, the self-recovery functional structure can guarantee the safety of people's life and property during earthquakes and can assist people in getting back a normal life as soon as possible after great earthquakes, thereby pointing out a new ideal direction for the earthquake-resistant design of structures. The self-recovery structural system primarily comprises a replaceable structural member, a swing structure, a self-recovery device, and so on. Research in recent years shows that the swing of the structure can reduce the influence of earthquakes and the requirements for the ductility of the structure, reduce earthquake damage, and reduce the manufacturing cost of the structure. The constraint between the structure and a foundation or between the members is released so that the structure can only be pressed, but not be tensioned on the contact surface with the foundation or on the contact surface between the members, and then the structure can swing in the earthquakes and can restore under the effect of a prestressing force, and in this way, a self-recovery structure is formed. The novel structural system can effectively control the maximum deformation of the structure and can reduce the residual deformation of the structure.

At present, many experts put forward the solution of arranging pre-stressed cables on frame beams of beam-column joints of a frame structural system to fulfill structural restoration after earthquakes, wherein short beam sections are connected with the columns through tensioning of the pre-stressed cables in a factory, only intermediate beam sections need to be assembled through all-bolted connection or welded-bolted connection at the construction site like common steel beams, and the pre-stressed cables do not need to be tensioned on site, so that construction is facilitated, the construction quality is improved, and installation time is shortened. However, self-restoration of concrete-filled steel-tube composite joint adopting high-strength steel bars between columns has yet to be researched and developed.

SUMMARY

The objective of the invention is to solve the above technical problems by providing a novel assembled self-recovery circular concrete-filled steel-tube composite joint.

To fulfill the above objective, the assembled self-recovery circular concrete-filled steel-tube composite joint comprises a circular steel-tube column and H-shaped steel beams, wherein steel bars penetrate through the circular steel-tube column which comprises an upper steel-tube column section, a central inserted-connection column section and a lower steel-tube column section; the upper steel-tube column section is connected with the central inserted-connection column section through an upper sleeve connector, and the central inserted-connection column section is connected with the lower steel-tube column section through a lower sleeve connector.

Steel bar fixing plates are fixed to the upper end of the upper steel-tube column section and the lower end of the lower steel-tube column section, are centrally provided with through holes, and are provided with steel bar holes around the through holes, the steel bars sequentially penetrate through the steel bar fixing plate at the upper end of the upper steel-tube column section, the circular steel-tube column and the steel bar fixing plate at the lower end of the lower steel-tube column section, and two ends of each steel bar are fixed by means of fasteners;

The upper sleeve connector comprises a circular tube, a connecting ring plate and an insertion plate, wherein the diameter of the circular tube is smaller than that of the circular steel-tube column, the connecting ring plate is arranged in the middle of the circular tube and comprises at least two end plates, and the insertion plate is fixed below the end plates and is vertically connected with the circular tube and the end plates; the lower sleeve connector is symmetrical with the upper sleeve connector in structure with an insertion plate fixed above end plates.

The upper end and the lower end of the central inserted-connection column section are provided with slots matched with the insertion plates.

The middle of a web at an end, connected to the circular steel-tube column, of each H-shaped steel beam is provided with a protrusive plate, wherein the distance between the upper edge of the protrusive plate and the upper flange of the H-shaped steel beam is not less than the height of the insertion plate of the upper sleeve connector, and the distance between the lower edge of the protrusive plate and the lower flange of the H-shaped steel beam is not less than the height of the insertion plate of the lower sleeve connector.

The circular tube on an upper half of the upper sleeve connector is inserted into the upper steel-tube column section, and the insertion plate of the upper sleeve connector is inserted into the slot in the upper end of the central inserted-connection column section; the circular tube on a lower half of the lower sleeve connector is inserted into the lower steel-tube column section, and the insertion plate of the lower sleeve connector is inserted into the slot in the lower end of the central inserted-connection column section; the protrusive plates of the H-shaped steel beams are inserted between the insertion plate of the upper sleeve connector and the insertion plate of the lower sleeve connector, the protrusive plates are connected with the two sides of each insertion plate in an overlapped manner through web connecting plates, the upper flanges of the H-shaped steel beams are connected with the end plates of the upper sleeve connector in an overlapped manner through flange connecting plates, and the lower flanges of the H-shaped steel beams are connected with the end plates of the lower sleeve connector in an overlapped manner through flange connecting plates.

Furthermore, the circular steel-tube column is connected with four H-shaped steel beams, and the connecting ring plate comprises four end plates arrayed in a cross shape.

Furthermore, the circular steel-tube column is connected with three H-shaped steel beams, and the connecting ring plate comprises three end plates arrayed in a T shape.

Furthermore, the circular steel-tube column is connected with two H-shaped steel beams, and the connecting ring plate comprises two end plates which are arrayed linearly or perpendicularly.

Furthermore, a gap between the upper steel-tube column section and the central inserted-connection column section and a gap between the lower steel-tube column section and the central inserted-connection column section are filled with rubber materials to prevent concrete from overflowing.

Furthermore, the insertion plates and the protrusive plates of the H-shaped steel beams are connected with the web connecting plates through high-strength bolts.

Furthermore, the insertion plates and the upper flange plates and lower flange plates of the H-shaped steel beams are connected with the flange connecting plates through the high-strength bolts.

The upper steel-tube column section, the central inserted-connection column section, the lower steel-tube column section, the upper sleeve connector, the lower sleeve connector and the H-shaped steel beams are pre-fabricated in a factory and only need to be assembled on site.

A method for assembling the assembled self-recovery circular concrete-filled steel-tube composite joint comprises the following steps:

I. Inserting the upper sleeve connector and the lower sleeve connector into the central inserted-connection column section;

II. Connecting the upper steel-tube column section with the upper sleeve connector, and connecting the lower steel-tube column section with the lower sleeve connector;

III. Inserting the protrusive plates of the H-shaped steel beams between the insertion plate of the upper sleeve connector and the insertion plate of the lower sleeve connector, and connecting the insertion plates with the two sides of each protrusive plate in the overlapped manner through the web connecting plates;

IV. Connecting the upper flanges of the H-shaped steel beams with the end plates of the upper sleeve connector in the overlapped manner through flange connecting plates, and connecting the lower flanges of the H-shaped steel beams with the end plates of the lower sleeve connector in the overlapped manner through the flange connecting plates;

V. Inserting the steel bars into the steel bar holes reserved in the steel bar fixing plate at the upper end of the upper steel-tube column section, wherein the steel bars sequentially penetrate through the upper steel-tube column section, the central inserted-connection column section, and the lower steel-tube column section, and finally stretch out of the steel bar holes reserved in the steel bar fixing plate at the lower end of the lower steel-tube column section, and two ends of each steel bar are screwed by means of screw nuts, so that fixed connection is completed.

VI. Pouring concrete into the circular steel-tube column via the through holes reserved in the steel bar fixing plates, so that connected parts are engaged to be fastened into a whole.

The invention has the following beneficial effects:

(1) According to the assembled self-recovery circular concrete-filled steel-tube composite joint, all members are machined in the factory and are connected on site through the bolts, so that fully-assembled construction is fulfilled, quality problems probably caused by site welding are avoided, the construction progress is accelerated, and labor productivity is improved.

(2) The group of steel bars penetrating through the joint, pre-stressed concrete, and other measures are taken, so that the assembled self-recovery circular concrete-filled steel-tube composite joint effectively overcomes the defects of poor integrity and poor earthquake resistance of the traditional pre-fabricated assembled structure, prevents untimely generation of cracks in concrete, and improves the connection reliability of vertical members, thereby improving structural integrity, fulfilling good earthquake resistance, and being effectively prevented from being damaged before the members during earthquakes.

(3) In small earthquakes, the assembled self-recovery circular concrete-filled steel-tube composite joint has the same functions as those of a common beam-column fixed-connection joint and can resist small earthquakes without being damaged; during moderate earthquakes, the cast-steel inner sleeve connector connected to a column end provides rotational stiffness, the central inserted-connection column section has a tendency to be separated from the upper steel-tube column section and the lower steel-tube column section, but the concrete in the steel-tube columns will not crack too early under the effect of the pre-stressing force from the group of the high-strength steel bars, and high-strength steel bars in the steel-tube columns are in an elastic state all the time when tensioned, and can be restored rapidly to perform the function after being deformed during the earthquakes; and in great earthquakes, the structure may be severely deformed, but will not collapse due to the good structural integrity, and any members damaged can be accurately disassembled and be quickly replaced after the earthquakes.

REFERENCE SIGNS

1, circular steel-tube column; 2, H-shaped steel beam; 3, upper steel-tube column section; 4, central inserted-connection column section; 5, lower steel-tube column section; 6, upper sleeve connector; 7, lower sleeve connector; 8, steel bar fixing plate; 9, steel bar; 10, circular tube; 11, connecting ring plate; 12, insertion plate; 13, end plate; 14, slot; 15, protrusive plate; 16, web connecting plate; 17, flange connecting plate.

DETAILED DESCRIPTION OF THE EMBODIMENTS

The invention is further expounded as follows in combination with the accompanying drawings.

Figure 1:
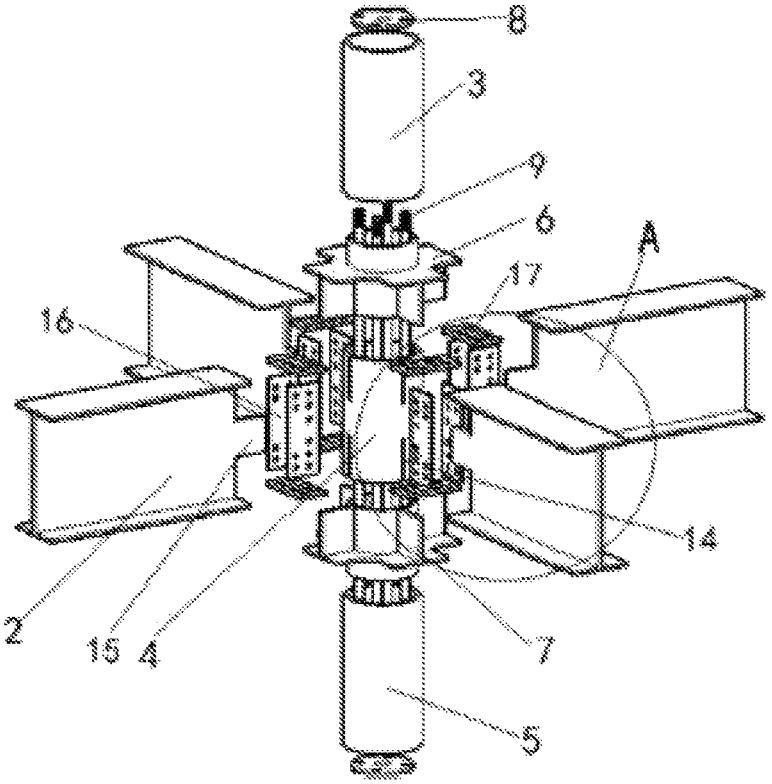
FIG. 1 is an exploded structural view of the invention.
Figure 2:
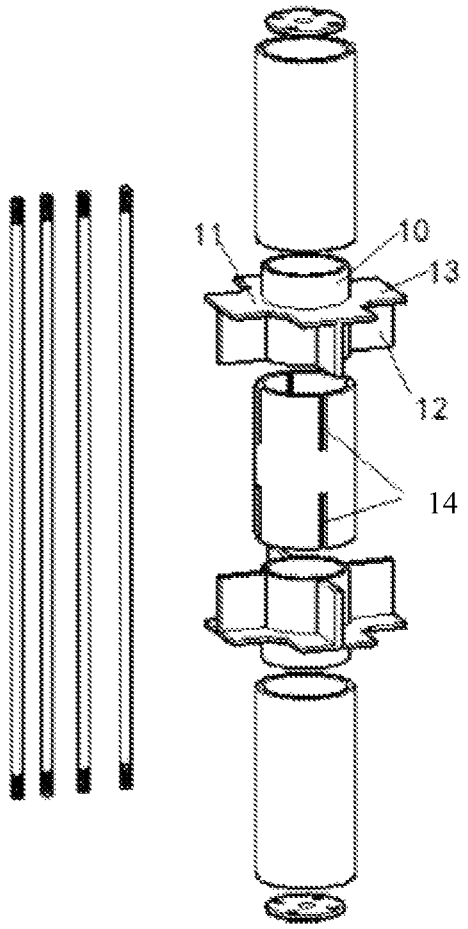
FIG. 2 is an exploded structural view of a circular steel-tube column of the invention.
Figure 3:
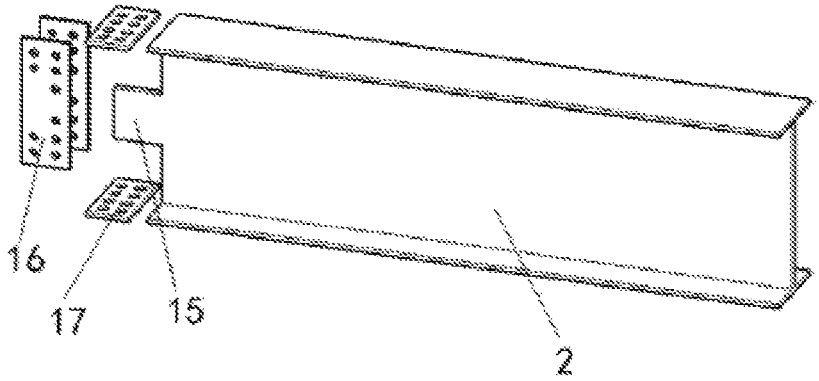
FIG. 3 is a partial exploded view of part A of the invention.

As shown in FIG. 1, FIG. 2, and FIG. 3, the assembled self-recovery circular concrete-filled steel-tube composite joint comprises a circular steel-tube column 1 and H-shaped steel beams 2, wherein steel bars 9 penetrate through the circular steel-tube column which comprises an upper steel-tube column section 3, a central inserted-connection column section 4 and a lower steel-tube column section 5; the upper steel-tube column section is connected with the central inserted-connection column section through an upper sleeve connector 6, and the central inserted-connection column section is connected with the lower steel-tube column section through a lower sleeve connector 7.

Steel bar fixing plates 8 are fixed to the upper end of the upper steel-tube column section and the lower end of the lower steel-tube column section, are centrally provided with through holes, and are provided with steel bar holes around the through holes, the steel bars sequentially penetrate through the steel bar fixing plate at the upper end of the upper steel-tube column section, the circular steel-tube column section, and the steel bar fixing plate at the lower end of the lower steel-tube column section, and two ends of each steel bar are fixed by means of fasteners.

The upper sleeve connector comprises a circular tube 10, a connecting ring plate 11 and an insertion plate 12, wherein the diameter of the circular tube is smaller than that of the circular steel-tube column, the connecting ring plate is arranged in the middle of the circular tube and comprises at least two end plates 13, and the insertion plate is fixed below the end plates and is vertically connected with the circular tube and the end plates; and the lower sleeve connector is symmetrical with the upper sleeve connector in structure with an insertion plate fixed above end plates.

According to the position of the joint in a building frame, if the circular steel-tube column is connected with four H-shaped steel beams, the connecting ring plate comprises four end plates arrayed in a cross shape; if the circular steel-tube column is connected with three H-shaped steel beams, the connecting ring plate comprises three end plates arrayed in a T shape; or, if the circular steel-tube column is connected with two H-shaped steel beams, the connecting ring plate comprises two end plates which are arrayed linearly or perpendicularly.

The upper end and the lower end of the central inserted-connection column section are provided with slots 14 matched with the insertion plates.

The middle of a web at an end, connected to the circular steel-tube column, of each H-shaped steel beam is provided with a protrusive plate 15, wherein the distance between the upper edge of the protrusive plate and the upper flange of the H-shaped steel beam is not less than the height of the insertion plate of the upper sleeve connector, and the distance between the lower edge of the protrusive plate and the lower flange of the H-shaped steel beam is not less than the height of the insertion plate of the lower sleeve connector.

Figure 4:
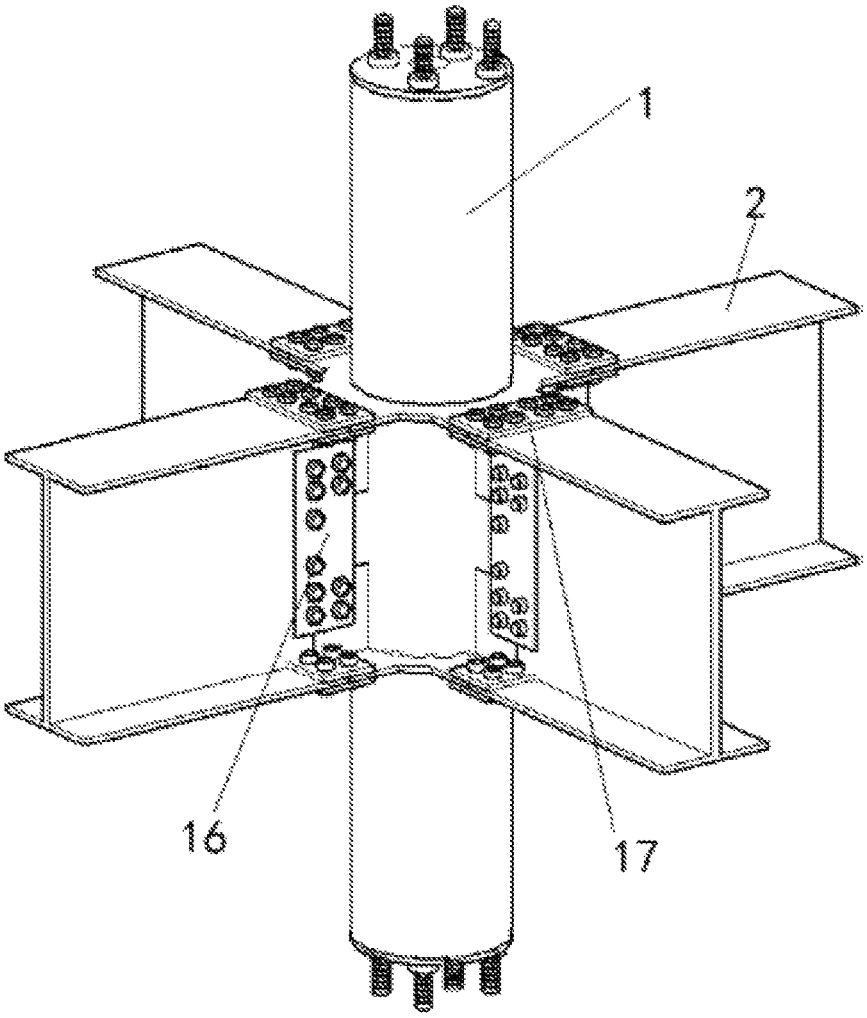
FIG. 4 is an assembly drawing of the invention.

During connection, the circular tube on an upper half of the upper sleeve connector is inserted into the upper steel-tube column section, and the insertion plate of the upper sleeve connector is inserted into the slot in the upper end of the central inserted-connection column section; the circular tube on a lower half of the lower sleeve connector is inserted into the lower steel-tube column section, and the insertion plate of the lower sleeve connector is inserted into the slot in the lower end of the central inserted-connection column section; the protrusive plates of the H-shaped steel beams are inserted between the insertion plate of the upper sleeve connector and the insertion plate of the lower sleeve connector, the protrusive plates and the insertion plates are connected in an overlapped manner through web connecting plates 16 additionally arranged on the insertion plates and two sides of each protrusive plate, and the insertion plates, the protrusive plates, and the web connecting plates are connected through high-strength bolts; the upper flanges of the H-shaped steel beams are connected with the end plates of the upper sleeve connector in an overlapped manner through additionally-arranged flange connecting plates 17, the lower flanges of the H-shaped steel beams are connected with the end plates of the lower sleeve connector in an overlapped manner through additionally-arranged flange connecting plates 17, and the upper flanges and the lower flanges are connected with the end plates through high-strength bolts. A connection diagram is shown in FIG. 4.

The upper steel-tube column section, the central inserted-connection column section, the lower steel-tube column section, the upper sleeve connector, the lower sleeve connector, and the H-shaped steel beams are prefabricated in a factory and just need to be assembled on site.

A method for assembling the assembled self-recovery circular concrete-filled steel-tube composite joint comprises the following steps:

I. The upper sleeve connector and the lower sleeve connector are respectively inserted into the central inserted-connection column section;

II. The upper steel-tube column section is connected with the upper sleeve connector, and the lower steel-tube column section is connected with the lower sleeve connector;

III. The protrusive plates of the H-shaped steel beams are inserted between the insertion plate of the upper sleeve connector and the insertion plate of the lower sleeve connector, and the insertion plates are connected with the two sides of each protrusive plate in the overlapped manner through web connecting plates;

IV. The upper flanges of the H-shaped steel beams are connected with end plates of the upper sleeve connector in the overlapped manner through the flange connecting plates, and the lower flanges of the H-shaped steel beams are connected with the end plates of the lower sleeve connector in the overlapped manner through the flange connecting plates;

V. The steel bars are inserted into the steel bar holes reserved in the steel bar fixing plate at the upper end of the upper steel-tube column section, wherein the steel bars sequentially penetrate through the upper steel-tube column section, the central inserted-connection column section, and the lower steel-tube column section, and finally stretch out of steel bar holes reserved in the steel bar fixing plate at the lower end of the lower steel-tube column section, and two ends of each steel bar are screwed by means of screw nuts, so that fixed connection is completed.

VI. Concrete is poured into the circular steel-tube column via the through holes reserved in the steel bar fixing plates, so that connected parts are engaged to be fastened into a whole; and in order to prevent concrete from overflowing, a gap between the upper steel-tube column section and the central inserted-connection column section and a gap between the lower steel-tube column section and the central inserted-connection column section are filled with rubber materials.

The above embodiments are only preferred ones of the invention, and are not intended to limit the invention. Those skilled in this field are permitted to make various changes and transformations, and all modifications, equivalent replacements, improvements, and the like achieved within the spirit and the principle of the invention should fall within the protection scope of the invention.

What is claimed is:

1. An assembled self-recovery circular concrete-filled steel-tube composite joint, comprising: a circular steel-tube column and H-shaped steel beams, wherein steel bars penetrate through the circular steel-tube column; the circular steel-tube column comprises an upper steel-tube column section, a central inserted-connection column section and a lower steel-tube column section; the upper steel-tube column section is connected to the central inserted-connection column section through an upper sleeve connector, and the central inserted-connection column section is connected to the lower steel-tube column section through a lower sleeve connector;

steel bar fixing plates are fixed to an upper end of the upper steel-tube column section and a lower end of the lower steel-tube column section, are centrally provided with through holes, and are provided with steel bar holes around the through holes, and the steel bars sequentially penetrate through the steel bar fixing plate at the upper end of the upper steel-tube column section, the circular steel-tube column section, and the steel bar fixing plate at the lower end of the lower steel-tube column section;

the upper sleeve connector comprises a circular tube, a connecting ring plate and an insertion plate, wherein a diameter of the circular tube is smaller than a diameter of the circular steel-tube column, the connecting ring plate is arranged in a middle of the circular tube and comprises at least two end plates, and the insertion plate is fixed below each end plate and is vertically connected to the circular tube and the each end plate; the lower sleeve connector is symmetrical with the upper sleeve connector in structure; an insertion plate is fixed above the each end plate;

an upper end and a lower end of the central inserted-connection column section are provided with slots matched with the insertion plates;

a middle of a web at an end, connected to the circular steel-tube column section, of each H-shaped steel beam is provided with a protrusive plate, wherein a distance between an upper edge of the protrusive plate and an upper flange of the each H-shaped steel beam is not less than a height of the insertion plate of the upper sleeve connector, and a distance between a lower edge of the protrusive plate and a lower flange of the each H-shaped steel beam is not less than a height of the insertion plate of the lower sleeve connector; and the circular tube on an upper half of the upper sleeve connector is inserted into the upper steel-tube column section, and the insertion plate of the upper sleeve connector is inserted into the slot in the upper end of the central inserted-connection column section; the circular tube on a lower half of the lower sleeve connector is inserted into the lower steel-tube column section, and the insertion plate of the lower sleeve connector is inserted into the slot in the lower end of the central inserted-connection column section; the protrusive plates of the H-shaped steel beams are inserted between the insertion plate of the upper sleeve connector and the insertion plate of the lower sleeve connector, the insertion plates are connected to two sides of each protrusive plate in an overlapped manner through web connecting plates, the upper flanges of the H-shaped steel beams are connected to the end plates of the upper sleeve connector in an overlapped manner through flange connecting plates, and the lower flanges of the H-shaped steel beams are connected to the end plates of the lower sleeve connector in an overlapped manner through flange connecting plates.

2. The assembled self-recovery circular concrete-filled steel-tube composite joint according to claim 1, wherein the circular steel-tube column is connected to four H-shaped steel beams, and the connecting ring plate comprises four end plates arrayed in a cross shape.

3. The assembled self-recovery circular concrete-filled steel-tube composite joint according to claim 1, wherein the circular steel-tube column is connected to three H-shaped steel beams, and the connecting ring plate comprises three end plates arrayed in a T shape.

4. The assembled self-recovery circular concrete-filled steel-tube composite joint according to claim 1, wherein the circular steel-tube column is connected to two H-shaped steel beams, and the connecting ring plate comprises two end plates arrayed linearly or perpendicularly.

5. The assembled self-recovery circular concrete-filled steel-tube composite joint according to claim 1, wherein a gap between the upper steel-tube column section and the central inserted-connection column section and a gap between the lower steel-tube column section and the central inserted-connection column section are filled with rubber materials to prevent concrete from overflowing.

6. The assembled self-recovery circular concrete-filled steel-tube composite joint according to claim 1, wherein the insertion plates and the protrusive plates of the H-shaped steel beams are connected to the web connecting plates through high-strength bolts.

7. The assembled self-recovery circular concrete-filled steel-tube composite joint according to claim 1, wherein the insertion plates and the upper flange plates and lower flange plates of the H-shaped steel beams are connected to the flange connecting plates through high-strength bolts.

8. A method for assembling the assembled self-recovery circular concrete-filled steel-tube composite joint according to claim 1, comprising the following steps:

I. inserting the upper sleeve connector and the lower sleeve connector into the central inserted-connection column section;

II. connecting the upper steel-tube column section with the upper sleeve connector, and connecting the lower steel-tube column section with the lower sleeve connector;

III. inserting the protrusive plates of the H-shaped steel beams between the insertion plate of the upper sleeve connector and the insertion plate of the lower sleeve connector, and connecting the insertion plates with the two sides of the each protrusive plate in the overlapped manner through the web connecting plates;

IV. connecting the upper flanges of the H-shaped steel beams with the end plates of the upper sleeve connector in the overlapped manner through the flange connecting plates, and connecting the lower flanges of the H-shaped steel beams with the end plates of the lower sleeve connector in the overlapped manner through the flange connecting plates;

V. inserting the steel bars into the steel bar holes reserved in the steel bar fixing plate at the upper end of the upper steel-tube column section, wherein the steel bars sequentially penetrate through the upper steel-tube column section, the central inserted-connection column section, and the lower steel-tube column section, and finally stretch out of the steel bar holes reserved in the steel bar fixing plate at the lower end of the lower steel-tube column section, and two ends of each steel bar are screwed by screw nuts, to complete fixed connection; and VI. pouring concrete into the circular steel-tube column via the through holes reserved in the steel bar fixing plates to engage with connected parts to be fastened into a whole.

9. The method for assembling the assembled self-recovery circular concrete-filled steel-tube composite joint according to claim 8, wherein the circular steel-tube column is connected to four H-shaped steel beams, and the connecting ring plate comprises four end plates arrayed in a cross shape.

10. The method for assembling the assembled self-recovery circular concrete-filled steel-tube composite joint according to claim 8, wherein the circular steel-tube column is connected to three H-shaped steel beams, and the connecting ring plate comprises three end plates arrayed in a T shape.

11. The method for assembling the assembled self-recovery circular concrete-filled steel-tube composite joint according to claim 8, wherein the circular steel-tube column is connected to two H-shaped steel beams, and the connecting ring plate comprises two end plates arrayed linearly or perpendicularly.

12. The method for assembling the assembled self-recovery circular concrete-filled steel-tube composite joint according to claim 8, wherein a gap between the upper steel-tube column section and the central inserted-connection column section and a gap between the lower steel-tube column section and the central inserted-connection column section are filled with rubber materials to prevent concrete from overflowing.

13. The method for assembling the assembled self-recovery circular concrete-filled steel-tube composite joint according to claim 8, wherein the insertion plates and the protrusive plates of the H-shaped steel beams are connected to the web connecting plates through high-strength bolts.

14. The method for assembling the assembled self-recovery circular concrete-filled steel-tube composite joint according to claim 8, wherein the insertion plates and the upper flange plates and lower flange plates of the H-shaped steel beams are connected to the flange connecting plates through high-strength bolts.

* * * * *